US005755356A

United States Patent [19]

Bastiaens et al.

[11] Patent Number: 5,755,356

[45] Date of Patent: May 26, 1998

[54] COMPRESSIBLE SHEET DISPENSER

[75] Inventors: Willem V. Bastiaens, Medina; Joseph P. Callahan, Jr., St. Paul; David C. Windorski, Woodbury; Timothy A. Jacobs, Maple Grove, all of Minn.

[73] Assignee: Minnesota Mining and Manufacturing Company, St. Paul, Minn.

[21] Appl. No.: 632,252

[22] Filed: Apr. 15, 1996

[51] Int. Cl.[6] ..... B65H 1/00

[52] U.S. Cl. ..... 221/33; 221/63

[58] Field of Search ..... 221/33, 63, 45, 221/46, 301; 206/449, 812

[56] References Cited

U.S. PATENT DOCUMENTS

| | | | |
|---|---|---|---|
| 4,416,392 | 11/1983 | Smith | 221/45 |
| 4,653,666 | 3/1987 | Mertens | 221/45 |
| 4,895,746 | 1/1990 | Mertens | 428/40 |
| 4,907,825 | 3/1990 | Miles et al. | 281/51 |
| 5,050,909 | 9/1991 | Mertens et al. | 283/81 |
| 5,080,255 | 1/1992 | Windorski | 221/45 |
| 5,086,946 | 2/1992 | Blackwell et al. | 221/45 |
| 5,158,205 | 10/1992 | Bodziak et al. | 221/51 |
| 5,165,570 | 11/1992 | Windorski et al. | 221/46 |
| 5,167,346 | 12/1992 | Bodziak | 221/63 |
| 5,397,117 | 3/1995 | Mertens | 221/34 |
| 5,411,168 | 5/1995 | Mertens et al. | 221/22 |
| 5,518,144 | 5/1996 | Samuelson et al. | 221/33 |

*Primary Examiner*—Kenneth Noland

[57] ABSTRACT

A sheet dispenser including a housing, and a stack of dispensable sheets. A front wall of housing has edges that define a slot through which an end portion of the top sheet on the stack projects. That front wall normally projects above the top surface of the stack of sheets to position that end portion of the top sheet in a position projecting above an outer surface of the front wall where it can be easily grasped to withdraw the top sheet from the housing. At least a portion of the front wall is of flexible material so that it can be resiliently bent to lie along the top surface of the stack and thereby reduce the thickness of the dispenser when, for example, it is positioned on one of the pages of a book, magazine, personal organizer or the like that is closed.

17 Claims, 6 Drawing Sheets

COMPRESSIBLE SHEET DISPENSER

FIELD OF THE INVENTION

The invention relates to dispensers for sheets from a coherent stack of sheets, each sheet bearing at least a band of pressure-sensitive adhesive, such as a repositionable pressure-sensitive adhesive, by which it can be self-adhered to a variety of surfaces. The invention is particularly related to such dispensers which have low profiles so that they can be attached to an inside page of a magazine, catalog, notebook, personal organizer or the like without creating an unsightly bulge.

BACKGROUND OF THE INVENTION

Minnesota Mining and Manufacturing Company or 3M (the company to which this application is assigned) has developed a rather low profile dispenser for a stack of paper sheets that is described in co-assigned U.S. Pat. No. 5,158,205 (Bodziak et al.). In FIGS. 1–6 of the Bodziak patent, a dispenser made of folded card stock forms a chamber closely containing a stack (12) of paper sheets. Centrally across the top wall (22) of that dispenser is a slot (30) through which paper sheets can be successively pulled from the stack. Each of the sheets has a narrow band of repositionable pressure-sensitive adhesive (14) coated on one surface adjacent one edge. When the uppermost sheet of the stack is pulled through the slot, flanking slits (24) at each end of the slot allow one of two opposed flap-like portions (28) of the top wall to flex as shown in FIG. 4 while the other flap-like portion places a drag on the next sheet so that the uppermost sheet will peel away from the next sheet.

The pop-up dispenser of the Bodziak patent is being used for coherent stacks of "Post-it"® brand self-stick repositionable notes that consist of pieces of paper, each having a narrow band of repositionable pressure-sensitive adhesive coated on one surface adjacent one edge. Among a variety of other pop-up dispensers that have been described in the art for use with coherent stacks of "Post-it"® brand self-stick repositionable notes are those disclosed in co-assigned U.S. Pat. Nos. 4,416,392 (Smith), 4,653,666 (Mertens), 5,080,255 (Windorski), 5,165,570 (Windorski et al), 5,167,346 (Bodziak et al) and 5,158,205 (Bodziak et al). FIGS. 1–13 of U.S. Pat. No. 5,165,570 illustrate dispensers having a base surface bearing a pair of foam-backed pressure-sensitive adhesive strips covered with a release liner by which the dispenser can be adhesively anchored to a substrate.

U.S. Pat. Nos. 5,411,168 and 5,397,117 (the contents whereof are incorporated herein by reference) describe low profile sheet dispenser subassemblies and low profile sheet dispensers for coherent stacks of "Post-it"® brand self-stick repositionable notes, for coherent stacks of "Post-it"® brand repositionable tape flags described in co-assigned U.S. Pat. No. 4,907,825, and other coherent stacks of adhesive-bearing sheets such as those described in U.S. Pat. No. 4,895,746 (Mertens) and U.S. Pat. No. 5,086,946 (Blackwell); which low profile sheet dispenser subassemblies or sheet dispensers are adapted to be adhered to a substrate such as on an inside page of a book, catalog, brochure, personal organizer or the like.

While all of the aforementioned low profile dispensers work well for their intended purpose, they have the disadvantage that the end portion of the next sheet to be withdrawn from the dispenser lies along the top surface of the dispenser where it is more difficult to grasp than are the end portions of sheets that project above the top surface of the dispenser as do the sheets in the dispensers described in U.S. Pat. No. 4,907,825 (Miles et al); U.S. Pat. No. 5,050,909 (Mertens et al); U.S. Pat. No. 5,158,205 (Bodziak), U.S. Pat. No. 5,086,946 (Blackwell et al), and U.S. patent application Ser. No. 08/263,601 (Samuelson et al).

SUMMARY OF THE INVENTION

The present invention provides an improved novel structure for sheet dispensers including coherent stacks of "Post-it"® brand self-stick repositionable notes, "Post-it"® brand tape flags, or lengths of adhesive coated tape in a housing; which dispensers have low profiles like the above-discussed low-profile dispensers, permitting them to be positioned unobtrusively on an inside page of a closed book, catalog, brochure, personal organizer or the like, while still, when exposed for use, presenting an end of the next sheet to be dispensed in a position projecting above an outer surface of the housing for the dispenser where it can be easily grasped by a person wishing to withdraw the sheet from the dispenser.

Generally, the sheet dispenser according to the present invention comprises a stack of dispensable sheets (e.g., repositionable paper notes, tape flags, or lengths of adhesive coated tape) disposed one on top of another; and a housing having walls defining a chamber in which the stack of dispensable sheets is positioned. The walls defining the chamber include a rear wall positioned adjacent the lowermost sheet in the stack and a front wall having an outer surface opposite the chamber and having adjacent edges defining a through slot extending transversely across the stack. The first end portion of the uppermost dispensable sheet in the stack projects through the slot. The dispensable sheets include means for releasably adhering the uppermost sheet to the first end portion of the underlying sheet in the stack sufficiently to carry the first end of the underlying sheet through the slot when the first sheet is removed from the dispenser by manually pulling the first end portion of the uppermost sheet through the slot and to thereby position the first end portion of the underlying dispensable sheet in a position extending through the slot as a result of the dispensing. The front wall of the housing is movable between (a) a projecting position with the front wall projecting above the stack and disposed to support the first end portion of the uppermost sheet in a position projecting above the outer surface of the front wall; and (b) a retracted position with the front wall disposed closer to and generally parallel with the sheets on the stack to reduce the thickness of the dispenser. Such movement to the retracted position can be caused, for example, by closing a book with the dispenser positioned between the pages of that book.

Dispensers according to the present invention can be either (1) of the type in which the bottom sheet of the stack of sheets is attached to the rear wall of the housing or the stack is otherwise restricted from significant movement in the chamber and the sheets are dispensed through a fairly wide slot as is taught in U.S. patent application Ser. No. 08/263,601 (Samuelson et al), or (2) of the type in which the stack of sheets is free to reciprocate in the housing as the sheets are dispensed and the sheets are dispensed through a rather narrow slot as is taught in U.S. Pat. No. 4,907,825 (Miles et al).

In several embodiments of such dispensers according to the present invention in which the bottom sheet of the stack of sheets is attached to the rear wall of the housing and the sheets are dispensed through a fairly wide slot, the front wall comprises front wall portions formed of resiliently flexible material. Those front wall portions provide the adjacent edges that define the slot and have proximal ends attached to the rear wall. In the projecting position parts of the front wall portions project above the stack to support the first end portion of the uppermost sheet in a position projecting above the outer surface of the front wall; and the front wall portions are resiliently bendable to the retracted position with the first end portion of the uppermost sheet and the front wall portions disposed generally parallel with the other sheets on the stack to reduce the thickness of the dispenser.

In one of those several embodiments, each front wall portion has two sections that are generally planar, are attached side to side to each other at adjacent sides, and, in the projecting position of the front wall portions, are disposed at an included angle in the range of about 60 to 140 degrees with respect to each other with the adjacent sides of the sections providing the parts of the front wall portions that will support the first end portion of the uppermost sheet in a position projecting above the outer surface of the front wall.

In another embodiment of the dispenser according to the present invention of the type in which the stack of sheets is free to reciprocate in the housing as the sheets are dispensed and the sheets are dispensed through a rather narrow slot the front wall is formed of resiliently flexible material (e.g., tag board or polymeric material), and is attached to a rear wall of the housing along its periphery with the front wall normally arched away from the rear wall. The dispenser includes means for retaining the stack along the rear wall of the housing so that the arched front wall above the stack supports the first end portion of the uppermost sheet in a position projecting above the outer surface of the front wall. The front wall is then resiliently compressible to the retracted position with the front wall and the first end portion of the uppermost sheet on the stack disposed generally parallel with the other sheets in the stack to reduce the thickness of the dispenser.

In yet another embodiment of the dispenser according to the present invention (which could be of either of the reciprocating or non-reciprocating types described above) the front wall comprises an outer layer of limp flexible material defining its outer surface, and a layer of resiliently compressible material between its outer layer and the stack of dispensable sheets which normally positions the front wall in its projecting position with its edges defining the slot in a position projecting above the stack to support the first end portion of the uppermost sheet in a position projecting above the outer surface of the front wall. That layer of resiliently compressible material is resiliently compressible to the retracted position of the front wall at which its outer surface is disposed closer to the sheets on the stack to reduce the thickness of the dispenser.

In yet another embodiment of a dispenser according to the present invention of the type in which the stack of sheets is free to reciprocate in the housing as the sheets are dispensed and the sheets are dispensed through a rather narrow slot the front wall comprises a front wall portion formed of stiff material having a through passageway aligned with and generally corresponding in size and shape to the slot, and two resiliently flexible front wall portions of resiliently flexible material. The flexible front wall portions have attached end parts attached along the inner surface of the front wall portion on opposite sides of the passageway and projecting end parts adapted to project across the passageway in overlapped relationship. The first end portion of the uppermost sheet projects between the end parts and through the slot. Withdrawing the uppermost sheet from the stack arches and moves the two projecting end parts to opposed relationship projecting through the passageway generally at a right angle to and away from the outer surface of the stiff front wall portion to define the slot therebetween. The first end portion of the second sheet in the stack then projects between the projecting end parts and is supported in a position projecting above the outer surface of the front wall. The projecting end parts will then support in that same position the end portions of subsequent sheets positioned to be withdrawn from the dispenser as a result of the previous sheet being withdrawn from the dispenser. When desired, however the projecting end parts can be manually returned to their overlapped relationship with the first end portion of the new uppermost sheet in the stack projecting between the end parts and laying along the outer surface of the front wall, as may be desired to store the dispenser between the pages of a book or organizer.

BRIEF DESCRIPTION OF THE DRAWING

The present invention will be further described with reference to the accompanying drawing wherein like parts are identified with like reference numerals in the several views and wherein.

DESCRIPTION OF THE PREFERRED EMBODIMENTS

Figure 1:
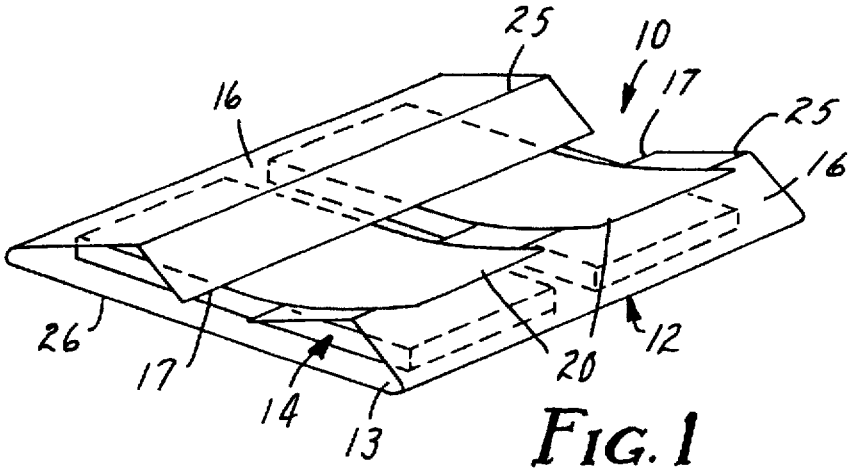
FIG. 1 is a perspective view of a first embodiment of a sheet dispenser according to the present invention.
Figure 2:
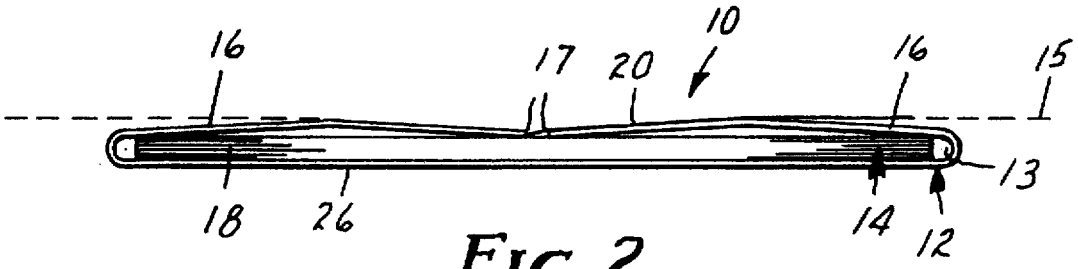
FIG. 2 is an end view of the sheet dispenser of FIG. 1 with front wall portions of its housing compressed to a retracted position.
Figure 3:
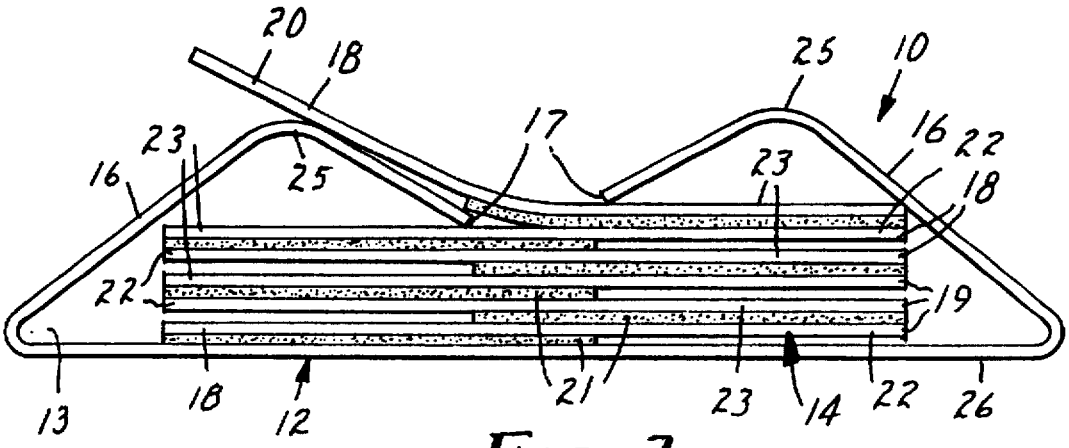
FIG. 3 is an enlarged end view of the sheet dispenser of FIG. 1.

Referring now to FIGS. 1, 2, and 3, there is illustrated a first embodiment of a sheet dispenser according to the present invention generally designated by the reference numeral 10. The sheet dispenser 10 includes a housing 12, and a stack 14 of dispensable sheets 18 (later to be generally explained, but which could be a stack of the "Post-it"® brand tape flags sold by Minnesota Mining and Manufacturing Company, St. Paul, Minn.) in a chamber 13 defined by walls of the housing 12. The dispenser 10 is of the type in which the bottom sheet of the stack 14 of sheets 18 is attached to the rear wall of the housing 12 and the sheets 18 are dispensed through a fairly wide slot as is taught in U.S. patent application Ser. No. 08/263,601 (Samuelson et al), the content whereof is incorporated herein by reference. Portions 16 of a front wall of the housing 12 have edges 17 that define that slot through which a first end portion 20 of the top sheet 18 on the stack 14 projects. As shown in FIG. 1, parts 25 of those front wall portions 16 normally project above the top surface of the stack 14 of sheets to position that first end portion 20 of the top sheet 18 in a position projecting above an outer surface of the front wall where the end portion 20 can be easily grasped to withdraw the top sheet 18 from the housing 12. The front wall portions 16 are of flexible material so that, as is shown in FIG. 2, they can be resiliently bent to lie along the top surface of the stack 14 of sheets and thereby reduce the thickness of the dispenser 10 when, for example, the dispenser 10 is positioned on one of the pages of a book, magazine, personal organizer or the like that is closed so that a surface such as a surface represented by the dotted line 15 presses the front wall portions 16 against the stack 14.

Generally, as can be seen in FIG. 3 that is illustrated with only six sheets 18 on the stack 14 that are much enlarged to show detail, the stack 14 in the dispenser 10 is of dispensable sheets 18 disposed one on top of another and including an uppermost sheet and a lowermost sheet. Each sheet 18 in the stack 14 comprises a backing 19 that has opposite upper and lower major side surfaces and opposite first and second ends with ends of the sheets being in alignment in the stack 14, and has a layer 21 of adhesive permanently adhered to the lower side surface of the backing 19. The layers 21 of adhesive of the sheets 18 are releasably adhered along the upper surfaces of the adjacent sheets in the stack 14. The sheets 18 comprise release means for providing a first adhesion level along first end portions 22 of the sheets adjacent the first ends of the backings between the lower side surfaces and the upper side surfaces of the adjacent sheets 18 in the stack 14 to which the layers 21 of adhesive are releasably adhered, which first adhesion level requires a sufficiently low or no release force between the lower side surfaces and the adjacent sheets 18 to which the layers 21 of adhesive along those lower side surfaces are releasable adhered to afford sliding and/or lifting movement between the side surfaces of the adjacent sheets 18 along the first end portions 22. Attachment means provide a second adhesion level along second end portions 23 of the sheets 18 adjacent the second ends of the backings 19 between the layers 20 of adhesive and the upper side surfaces of the adjacent sheets 18 in the stack 14 to which the layers 20 of adhesive are releasably adhered, which second adhesion level provides a release force that is higher than the sufficiently low or no release force along the first end portions 22 and firmly adhere the sheets 18 to the adjacent sheets 18 in the stack 14 during sliding and/or lifting movement of the sheets 18 relative to the adjacent sheets 18 along the first end portions 22 while affording peeling away of the sheets from the stack 14 along the second end portions 22. The sheets 18 illustrated have no coating of adhesive along their first end portions 22 so that the first adhesive level requires no release force to afford sliding and/or lifting movement between the side surfaces of the adjacent sheets 18 along the first end portions 22. Alternatively the sheets could be coated with adhesive along their entire lengths in which case a layer of release material would be required on the upper surface of the sheet 18 to which the adhesive on the first end portion 22 is adhered to provide the sufficiently low adhesive level that affords sliding and/or lifting movement between the side surfaces of the adjacent sheets 18 along the first end portions 22 and a second release level along the second end portion 23.

The walls defining the chamber in 13 in the housing 12 include a rear wall 26 positioned adjacent the lowermost sheet 18 in the stack 14 to which that lowermost sheet 18 is adhered, and the front wall that has the adjacent edges 17 defining the through slot extending transversely across the stack 14 through which the first end portion 20 of the uppermost dispensable sheet 18 in the stack 14 projects. The stack 14 of dispensable sheets 18 and the housing 12 are adapted to afford dispensing of the dispensable sheet 18 having its first end portion 20 extending through the slot when that first end portion 20 is manually pulled through the slot by sequential sliding and/or lifting movement of one of the dispensable sheets 18 relative to the adjacent dispensable sheet 18 along the first end portion 22 and peeling away of the dispensable sheet 18 from the stack 14 along its second end portion 23, and positioning of the first end portion 20 of an underlying dispensable sheet 18 in a position extending through the slot as a result of such dispensing.

The walls of the housing 12 for the dispenser 10 are thermoformed from one piece of a resiliently flexible polymeric material (e.g., about 0.012 inch or 0.030 centimeter thick polyester). The front wall of the dispenser 10 comprises the two allochiral front wall portions 16 that have at their distal ends the adjacent edges 17 that define the slot and have proximal ends 24 attached to the rear wall 26. Each of the front wall portions 16 includes two sections that are generally planar, are attached side to side to each other at adjacent sides, and are disposed at an included angle (e.g., about 130 degrees) with respect to each other. The adjacent sides of the sections provide the parts 25 of the front wall portions 16 projecting above the stack 14 to support the first end portion of the uppermost sheet in a position projecting above the outer surface of the front wall that are positioned generally centrally between the distal and proximal ends of the front wall portions 16. When the front wall portions 16 are pressed toward the top of the stack 14 (e.g., by closing a book in which the dispenser is positioned) the front wall portions 16 will resiliently bend to move the parts 25 of the front wall and the first end portion 20 of the uppermost sheet 18 closer to and into alignment along the top surface of the stack 14 as is illustrated in FIG. 2. When that pressing force is released, however, (e.g., by again opening the book) the front wall portions 16 will again return to their normal projecting positions (FIGS. 1 and 3) at which the parts 25 of the front wall portions 16 will again support the first end portion 20 of the uppermost sheet 18 in a position projecting above the outer surface of the front wall. If the sheets 18 dispensed from the dispenser 10 are coated with adhesive along their entire lengths, it is desirable to reduce the potential adhesion between that adhesive and the front wall portions 16 by embossing them or coating them with a release material.

Referring now to FIGS. 4 through 8, there are illustrated several alternate embodiments of sheet dispensers 30, 40, 50, 60, and 70 according to the present invention that are adapted to dispense sheets from the same type of stack 14 used in the dispenser 10 and like the dispenser 10 are also of the type in which the lowest sheet in the stack of sheets 14 is attached to a rear wall of the housing and the sheets 18 are dispensed through a fairly wide slot as is taught in U.S. patent application Ser. No. 08/263,601 (Samuelson et al). Like the dispenser 10, the walls of the housings for the dispensers 30 through 70 are thermo formed from one piece of a resiliently flexible polymeric material (e.g., about 0.030 centimeter or 0.012 inch thick polyester). The front walls for the housings each comprise two allochiral front wall portions having distal ends that provide adjacent edges defining a slot through which an end portion of the top sheet on the stack projects, and that have proximal ends opposite their distal ends that are attached to the rear wall. The front wall portions of the housings for the dispensers 30 through 70 have parts that normally project in a projecting position above the stack to support the first end portion of the uppermost sheet in a position projecting above the outer surface of its front wall, but which, when pressure is applied to them (e.g., by being pressed between the pages of a book) will resiliently flatten to a retracted position with the front wall portions and the first end portion of the uppermost sheet disposed closer to and generally parallel with the sheets on the stack to reduce the thickness of the dispenser. The dispensers 30 through 70 primarily differ from the dispenser 10 by the shape of their front wall portions.

Figure 4:
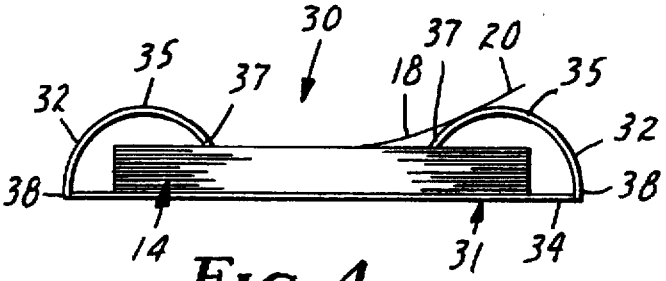
FIG. 4 is an end view of a second embodiment of a sheet dispenser according to the present invention.

For example, the dispenser 30 illustrated in FIG. 4 is generally the same as the dispenser 10 illustrated in FIGS. 1 through 3 except that the front wall portions 32 of the housing 31, instead of being generally V-shaped in cross section, are each arcuate in cross section and have cylindrically convex surfaces opposite the rear wall 34 to provide parts 35 generally centered between the distal and proximal ends 37 and 38 of the front wall portions 32 for supporting the first end portion 20 of the uppermost sheet 18 on the stack 18 in a position projecting above the outer surface of the front wall.

Figure 5:
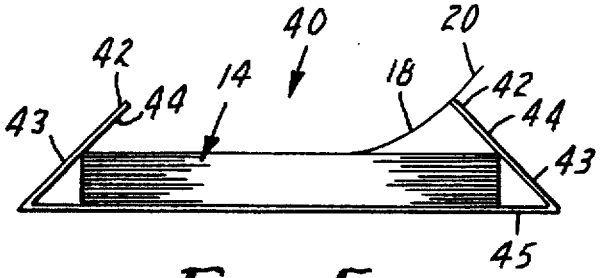
FIG. 5 is an end view of a third embodiment of a sheet dispenser according to the present invention.
Figure 6:
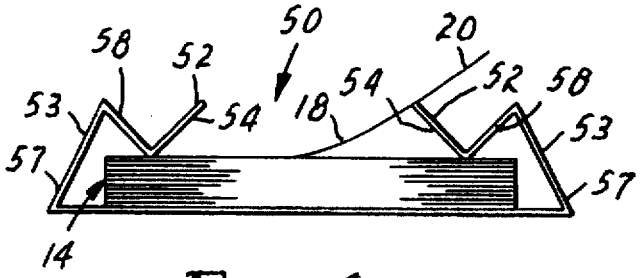
FIG. 6 is an end view of a fourth embodiment of a sheet dispenser according to the present invention.
Figure 7:
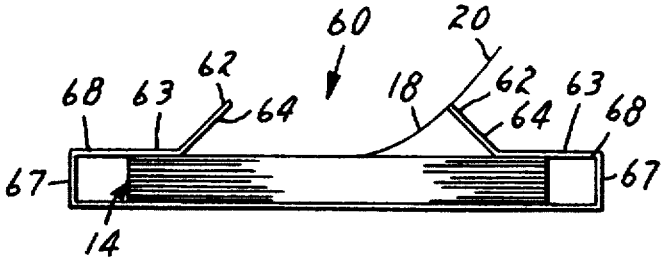
FIG. 7 is an end view of a fifth embodiment of a sheet dispenser according to the present invention.

On the housings of the dispensers 40, 50 and 60 illustrated in FIGS. 5, 6 and 7 respectively, the distal ends 42, 52, and 62 of the front wall portions 43, 53 and 63 provide the adjacent edges defining the slots, and the front wall portions 43, 53 and 63 comprise generally planar sections 44, 54 and 64 defining the distal ends 42, 52 and 62 disposed with the distal ends 42, 52 and 62 projecting above the stacks 14 of sheets 18 and providing the parts for supporting the first end portions 20 of the uppermost sheets in positions projecting above the outer surface of the front walls. In the dispenser 40, each front wall portion 43 is formed by only one planar section 44 attached to and projecting from the rear wall 45. In the dispenser 50 the planar sections 54 that define the distal ends 52 are supported at the ends of joined planar sections 57 and 58 disposed in generally inverted V-shaped orientations that bridge around the opposite ends of the stack 14 so that each of the front wall portions 53 has two sections 54 and 58 that are generally planar, are attached side to side to each other at adjacent sides, and are disposed at an included angle in the range of about 80 to 100 degrees with respect to each other. In the dispenser 60 the planar sections 64 that define the distal ends 62 are supported at the ends of joined planar sections 67 and 68 disposed generally at a right angle to each other that bridge around the opposite ends of the stack 14 so that each of the front wall portions 63 has two sections 64 and 68 that are generally planar, are attached side to side to each other at adjacent sides, and are disposed at an included angle in the range of about 120 to 140 degrees with respect to each other.

Figure 8:
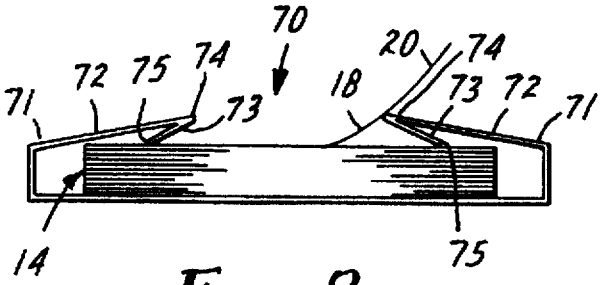
FIG. 8 is an end view of a sixth embodiment of a sheet dispenser according to the present invention.

In the dispenser 70 illustrated in FIG. 8 the front wall portions 71 each comprise first and second generally planar sections 72 and 73, which first and second sections 72 and 73 are joined to each other at adjacent sides 74 and are disposed at an acute angle with respect to each other with the sides 75 of the second sections 73 opposite those adjacent sides 74 being the distal ends and being supported on the stack 14, and the adjacent sides 74 on the two front wall portions 71 being spaced apart, having the edges defining the slot, and providing parts of the front wall portions 71 for supporting the first end portions 20 of the uppermost sheet 18 in a position projecting above the outer surface of the front wall.

Figure 9:
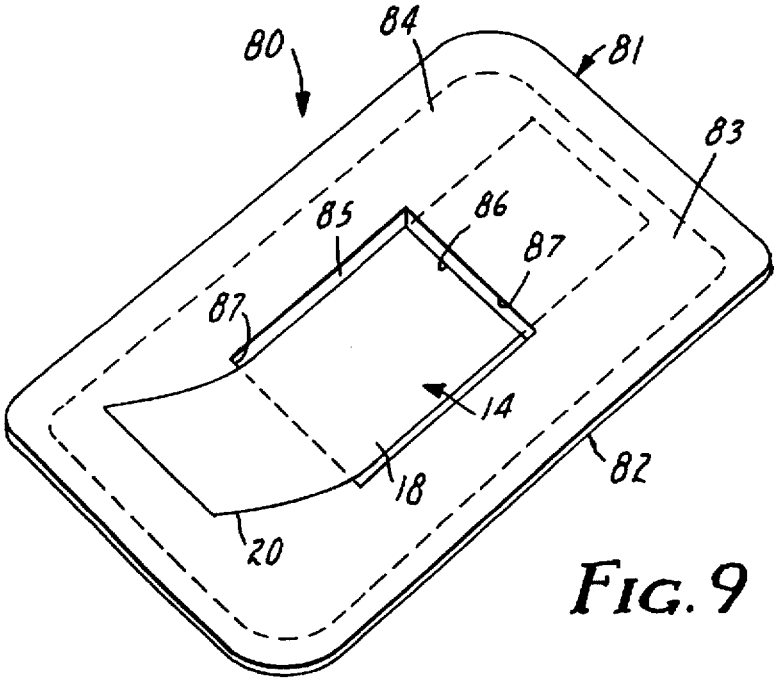
FIG. 9 is a perspective view of a seventh embodiment of a sheet dispenser according to the present invention.

FIG. 9 illustrates a dispenser 80 according to the present invention that is of the type in which the bottom sheet of the stack 14 of sheets 18 is attached to a rear wall 82 of a housing 81 and the sheets 18 are dispensed through a fairly wide slot as is taught in U.S. patent application Ser. No. 008/263,601 (Samuelson et al). The dispenser 80 comprises the housing 81 including the generally rectangular rear wall 82 which is of a flexible label stock material and has a layer of pressure sensitive adhesive covered by a release liner along its outer surface. The housing 81 also includes a generally rectangular front wall 83 comprising an outer layer 84 of limp flexible material (e.g., a polymeric material such as 0.0035 inch or 0.0089 centimeter thick polypropylene) attached around its periphery to the periphery of the rear wall 82 and a layer 85 of resiliently compressible material (e.g., ⅛ to ⅜ inch thick low density polymeric foam) adhered to the inner surface of the outer layer 84. The stack 14 of dispensable sheets, that can be the same as the stack 14 described above, is positioned in a chamber 86 defined between the compressible layer 85 and the rear wall 82 with an end portion 20 of the uppermost sheet 18 on the stack 14 projecting through an opening or slot in the front wall 83 defined by opposite edges 87. The compressible layer 85 normally elevates the edges 87 above the stack 14 so that the end portion 20 of the top sheet on the stack projects above the outer surface of the front wall 83. The layer 85 of resiliently compressible material, however, can be resiliently compressed to a retracted position with the outer surface of the front wall 83 disposed closer to the sheets 18 on the stack 14 to reduce the thickness of the dispenser 80 when, for example, the rear wall 82 of the dispenser 80 is attached along a page in a book and the book is closed. When the compressive force is relieved (e.g., when the book is opened) the compressible layer 85 will again expand to space the edges 87 from the stack 14 and again cause the end portion 20 of the top sheet 18 to project above the outer surface of the front wall where it can be easily grasped by a person wishing to withdraw it from the dispenser 80. The dispenser 80 could also be modified to be of the type in which the stack of sheets 14 is free to reciprocate in the chamber 86 as the sheets 18 are dispensed and the sheets 18 are dispensed through a rather narrow slot as is taught in U.S. Pat. No. 4,907,825 (Miles et al) by making the chamber 86 sufficiently long to afford such reciprocation and moving the edges 87 closer together to narrow the slot through which the sheets are dispensed.

Figure 10:
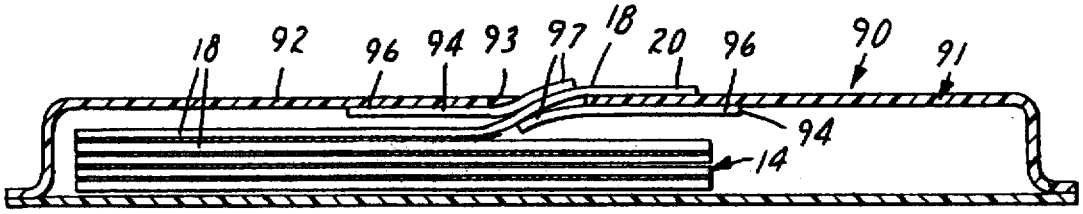
FIGS. 10, 11 and 12 are side sectional views of an eighth embodiment of a sheet dispenser according to the present invention respectively illustrating retracted, projecting and retracted positions for a front wall of the dispenser.
Figure 11:
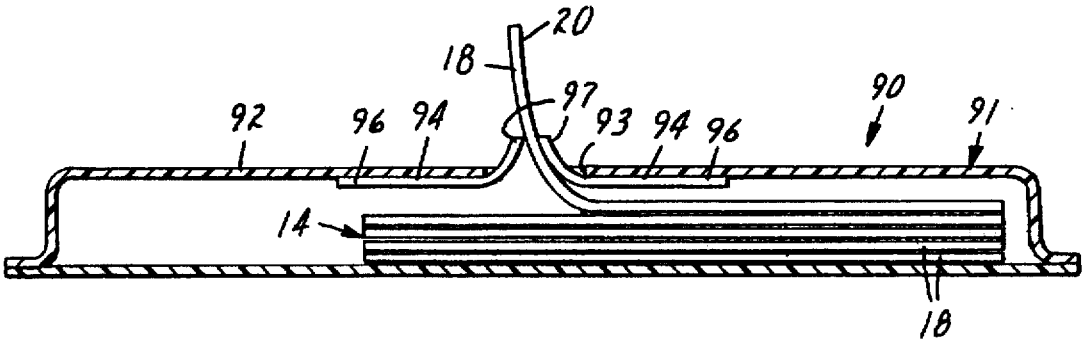
Figure 12:
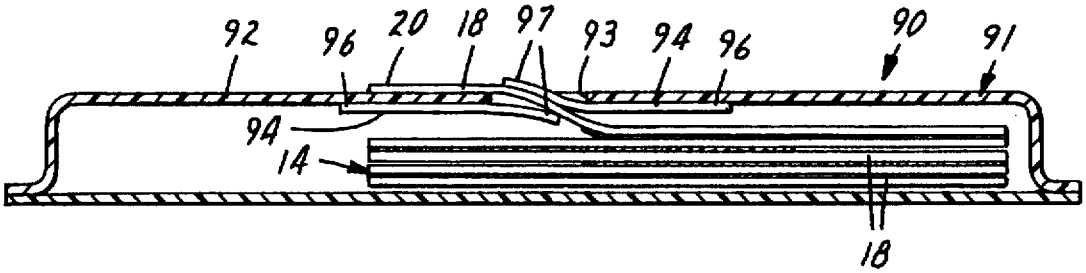
Figure 13:
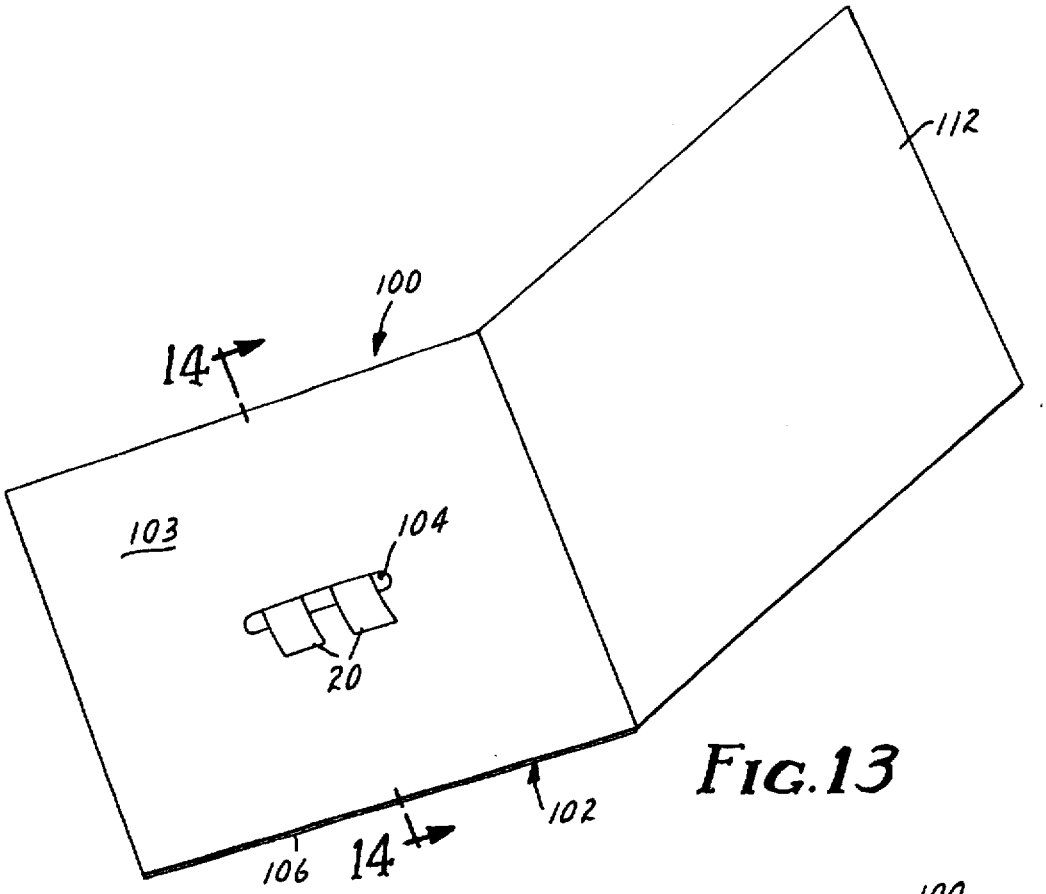
FIG. 13 is a perspective view of a ninth embodiment of a sheet dispenser according to the present invention.
Figure 14:
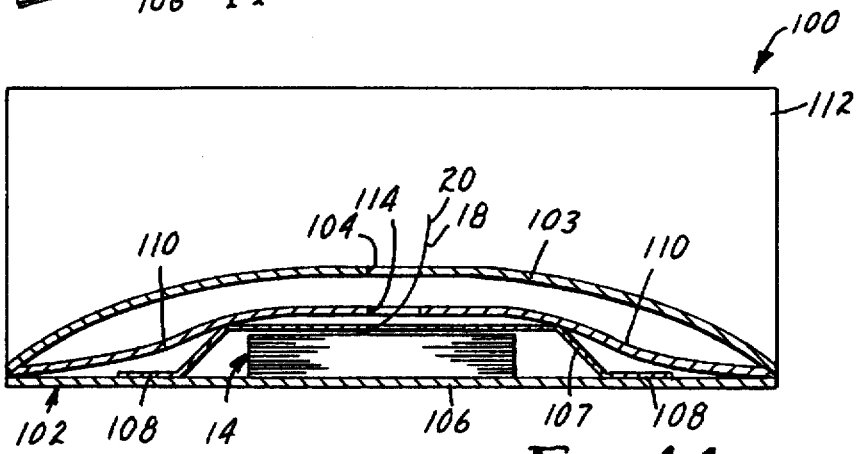
FIG. 14 is a sectional view taken approximately along line 14—14 of FIG. 13.
Figure 15:
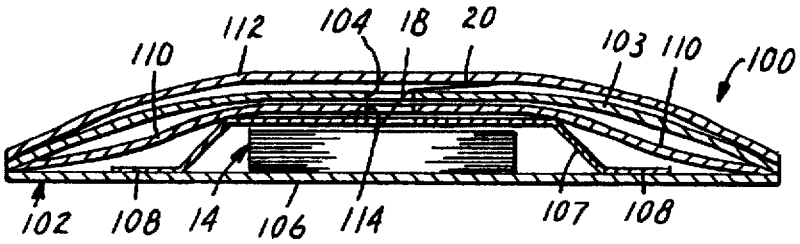
FIG. 15 is a sectional view similar to FIG. 14 but which shows a front wall of the dispenser in its retracted position and a cover on the dispenser in a closed position.

FIGS. 10 through 12 illustrate a dispenser 90 according to the present invention that is a modification of the dispenser sold under the trade designation "Post-it"® brand Tape Flags by Minnesota Mining and Manufacturing Co, St. Paul, Minn., that is described in U.S. Pat. No. 4,770,320 (Miles, et al), the content whereof is incorporated herein by reference. The dispenser 90 is of the type in which the stack 14 of sheets 18 is free to reciprocate in a housing as the sheets 18 are dispensed and the sheets 18 are dispensed through a rather narrow slot as is taught in U.S. Pat. No. 4,770,320

(Miles, et al). The housing 91 for the dispenser 90 differs from the housing or enclosure for the dispenser described in U.S. Pat. No. 4,770,320 in that rigid projections on a front wall for the housing that defined the outlet slot for the tape flags or sheets on the dispenser described in U.S. Pat. No. 4,770,320 have been removed and replaced with two flexible front wall portions 94. Thus, the front wall of the housing 91 in the dispenser 90 according to the present invention comprises a front wall portion 92 formed of stiff polymeric material having a through passageway 93 aligned with and generally corresponding in size and shape to the slot on the dispenser described in U.S. Pat. No. 4,770,320, and the two flexible front wall portions 94 (e.g., formed of 0.002 to 0.005 inch or 0.005 to 0.0127 centimeter thick polyester which for some applications may be coated with a release agent). The flexible front wall portions 94 have attached end parts 96 attached along the inner surface of the front wall portion 92 on opposite sides of the passageway 93 and projecting end parts 97 adapted to project across the passageway 93 in overlapped relationship in a retracted position of the front wall 92 (see FIG. 10). In that retracted position of the front wall 92 the first end portion 20 of the uppermost sheet 18 on the stack 14 projects between the projecting end parts 97, through the passageway 93, and along the outer surface of the front wall portion 92. Manually withdrawing the uppermost sheet 18 from the stack 14 arches and moves the projecting end parts 97 to opposed relationship projecting through the passageway 93 generally at a right angle to and away from the outer surface of the front wall 92 (see FIG. 11) to define an exit slot for the sheets 18 therebetween. The first end portion 20 of the uppermost sheet 18 in the stack then projects between the projecting end parts 97 and is supported in a position projecting above the outer surface of the front wall 92. The projecting end parts 97 will then support in that same position the end portions 20 of subsequent sheets 18 positioned to be withdrawn from the dispenser 90 as a result of sheets 18 being withdrawn from the dispenser 90. When desired, however the projecting end parts 97 can be manually returned to their overlapped relationship with the first end portion 20 of the new uppermost sheet 18 in the stack projecting between the overlapped end parts 97 and laying along the outer surface of the front wall 92 (see FIG. 12), as may be desired to store the dispenser 90 between the pages of a book or organizer. Such returning of the projecting end parts 97 to their overlapped relationship can be caused by pressing the outer ends of the projecting end parts 97 and the first end portion 20 of the sheet 18 projecting between them toward the stack 14 in the dispenser 90.

FIGS. 13, 14, 15 and 16 illustrate a ninth embodiment of a sheet dispenser according to the present invention, generally designated by the reference numeral 100, that is of the type in which the stack 14 of sheets 18 is free to reciprocate in a housing 102 as the sheets 18 are dispensed and the sheets 18 are dispensed through a rather narrow slot as is taught in U.S. Pat. No. 4,770,320 (Miles, et al). The sheet dispenser 100 includes the housing 102, and two stacks 14 of dispensable sheets (the stacks 14 are of one of the types described above, and as illustrated are stacks 14 of the ⅜ inch wide "Post-it"® brand tape flags sold by Minnesota Mining and Manufacturing Company, St. Paul, Minn., although 1 or more than 2 stacks could be used and could be of different widths). A front wall 103 of the housing 102 has opposite edges that define a slot 104 through which end portions 20 of the top sheets 18 on the stacks 14 project. The front wall 103 normally projects above the top surface of the stack 14 of sheets 18 (see FIGS. 13 and 14) to position those end portions 20 of the top sheets 18 in a position projecting above an outer surface of the front wall 103 where they can be easily grasped to withdraw either of the top sheets 18 from the housing 102. The front wall 103 is of flexible material (e.g., flexible 12 to 20 point card stock) so that it can be resiliently bent to lie closer to the top surfaces of the stacks 14 (FIG. 15) and thereby reduce the thickness of the dispenser 100 when, for example the dispenser 100 is positioned on one of the pages of a book, magazine, personal organizer or the like that is closed.

Figure 16:
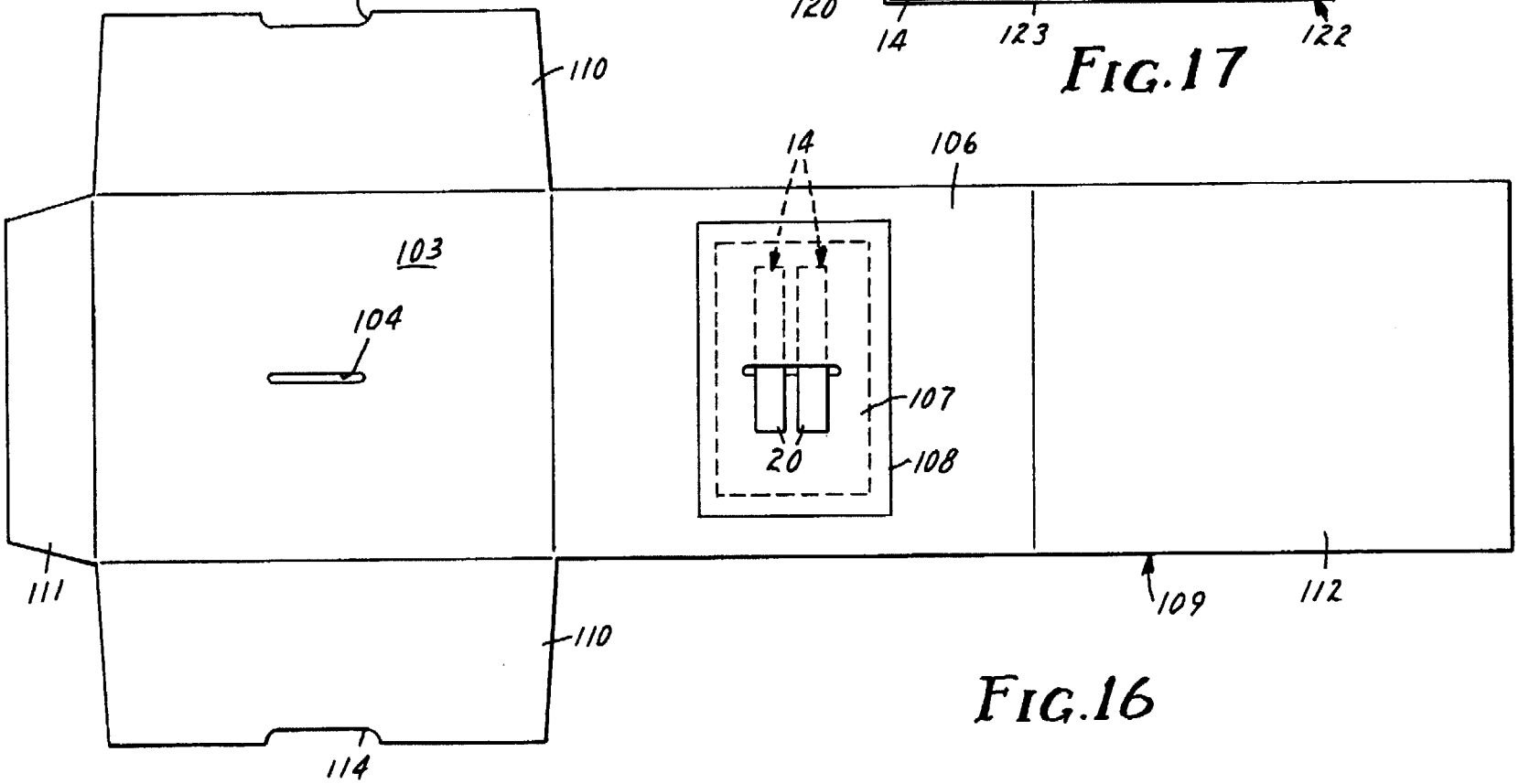
FIG. 16 is a plan view of a sub assembly from which the sheet dispenser of FIG. 13 is formed.

The housing 102 of the dispenser 100 includes a rectangular rear wall 106 of the same flexible material as the front wall 103, and means for retaining the stack 14 along the inner surface of its rear wall 106. That means, as illustrated, is a flexible cover layer 107 of the type described in U.S. Pat. No. 5,397,117 (Mertens, the content whereof is incorporated herein by reference) extending over the stacks 14 and having its periphery 108 adhered to the rear wall 106. FIG. 16 illustrates a sub-assembly including the stacks 14, the cover layer 107 and a formed sheet 109 of the resiliently flexible material from which much of the housing 102 is formed. The front wall 103 of the dispenser 100 is only a portion of that formed sheet 109 which also includes the rear wall 106, two spring portions 110 on opposite sides of the front wall 103, an attachment tab 111 at the side of the front wall 103 opposite the rear wall 106, and a cover 112 at the side of the rear wall 106 opposite the front wall 103. That formed sheet 109 is folded on opposite sides of the front wall 103 to position the spring portions 110 along the inner surface of the front wall 103, is then folded between the front wall 103 and the attachment tab 111 to position the attachment tab 111 along the surfaces of the spring portions 110 opposite the front wall 103, and is folded between the front wall 103 and the rear wall 106 to position the attachment tab 111 along the inner surface of the rear wall 106 to which it is adhesively attached. The end portions 20 of the sheets 18 are positioned to extend through opposed notches 114 in the spring portions 110 and the slot 104 in the front wall 103. The spring portions 110 then bridge across and lay along the cover layer 107, whereas the front wall 103 normally arches away from the spring portions 110 and cover layer 107 because of the resilience in the folds between the front wall 103 and the spring portions 110. In that position of the front wall 103, the opposite edges that define the slot 104 through which the end portions 20 of the top sheets 18 on the stack 14 project support those first end portion 20 in a position projecting above the outer surface of the front wall 103 as can best be seen in FIG. 14. The front wall 103, however, is resiliently moveable to a retracted position (FIG. 15) with the front wall 103 against the spring portions 110 and the first end portions 20 of the uppermost sheets 18 disposed along the outer surface of the front wall 103 to reduce the thickness of the dispenser 100. The cover 112 can be moved by bending the sheet 109 between the cover 112 and rear wall 106 between an open position (FIGS. 13 and 14) to afford access to the projecting end portion 20 of the top sheet 18, and a closed position (FIG. 15) for both applying pressure to move the front wall 103 to its retracted position and protecting the end portions 20 of the sheets 18 when the front wall 103 is in its retracted position.

Figure 17:
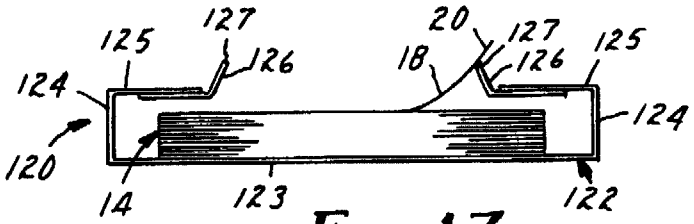
FIG. 17 is an end view of a tenth embodiment of a sheet dispenser according to the present invention.

Referring now to FIG. 17 there is illustrated a tenth embodiment of a sheet dispensers 120 according to the present invention that is adapted to dispense sheets from the same type of stack 14 used in the dispenser 10 and that is of the type in which the bottom sheet of the stack 14 of sheets 18 is attached to a rear wall 123 of a housing 122 and the sheets 18 are dispensed through a fairly wide slot as is taught in U.S. patent application Ser. No. 08/263,601 (Samuelson et al). The dispenser 120 includes the housing 122 that has the rear wall 123, two opposite side walls 124 and opposed parallel planar sections 125 of two opposed front wall portions that are thermo formed from one piece of a stiff resiliently flexible polymeric material. The front wall portions of the housing 122 also include two planar sections 126 of resiliently flexible material attached at the distal ends of the stiff sections 125 by having extending portions laminated thereto. The flexible planar sections 126 are disposed at an included angle in the range of 100 to 160 degrees (e.g., 115 degrees) with respect to the stiff sections 125. The flexible sections 126 have distal ends that provide adjacent edges 127 defining a slot through which an end portion 20 of the top sheet 18 on the stack 14 projects. The flexible sections 126 have parts that normally project in a projecting position above the stack 14 to support the first end portion 20 of the uppermost sheet 18 in a position projecting above the outer surface of the front wall of the housing 122. When pressure is applied to the flexible parts 126, however, (e.g., by being pressed between the pages of a book) they will resiliently flatten to a retracted position with the front wall portions and the first end portion 20 of the uppermost sheet 18 disposed closer to and generally parallel with the sheets 18 on the stack 14 to reduce the thickness of the dispenser 120.

Figure 18:
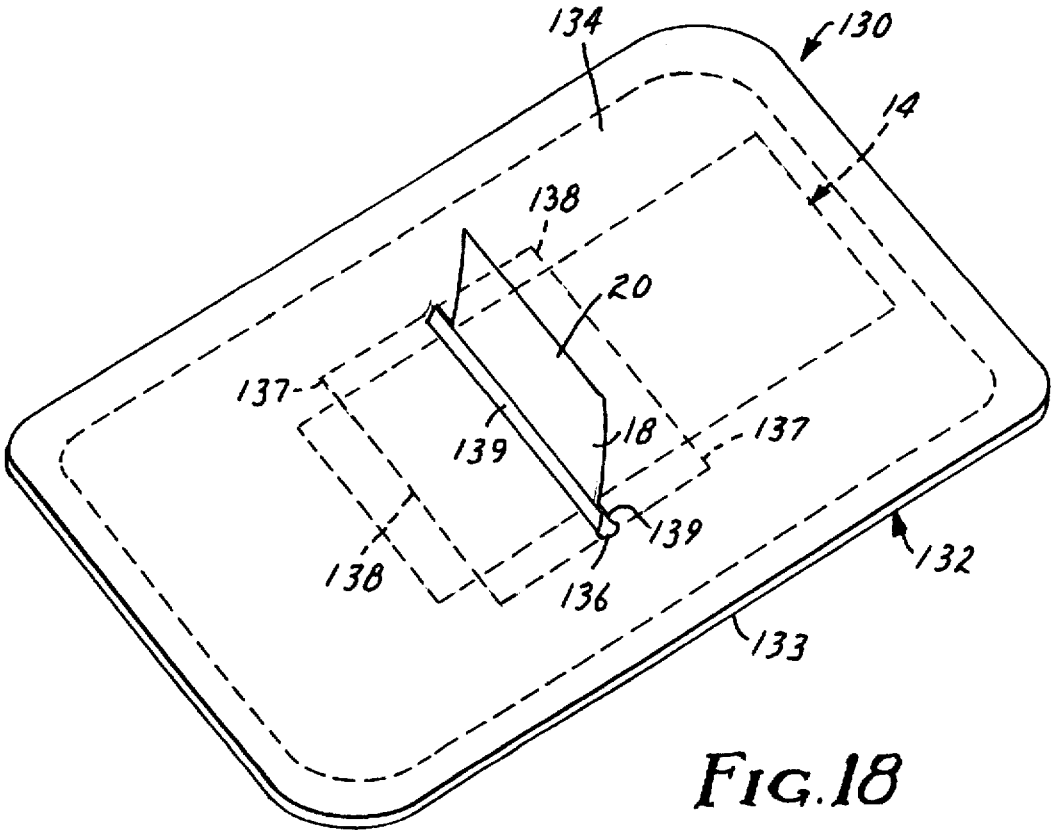
FIG. 18 is an perspective view of an eleventh embodiment of a sheet dispenser according to the present invention.

FIG. 18 illustrates a dispenser 130 according to the present invention that is of the type in which a stack 14 of sheets 18, that can be the same as the stack 14 described above, is free to reciprocate in a chamber in a housing 132 as the sheets 18 are dispensed and the sheets 18 are dispensed through a rather narrow slot as is taught in U.S. Pat. No. 4,770,320 (Miles, et al). The housing 132 includes a generally rectangular rear wall 133 which is of a flexible label stock material and has a layer of pressure sensitive adhesive covered by a release liner along its outer surface. The housing 132 also includes a generally rectangular flexible front wall including a main front wall portion 134 of a strong flexible material (e.g., a polymeric material such as 0.003 inch or 0.008 centimeter thick polypropylene) that is attached around its periphery to the periphery of the rear wall 133 and has a through centrally located passageway 136 transverse of the stack 14 of sheets 18 in the chamber. The front wall also includes two flexible sheet supporting front wall portions 137 (e.g., formed of 0.002 to 0.005 inch or 0.005 to 0.0127 centimeter thick polyester which for some applications may be coated with a release agent). The two flexible supporting front wall portions 137 have attached end parts 138 attached along the inner surface of the main front wall portion 134 on opposite sides of the passageway 136 and projecting end parts 139 projecting in opposed relationship through the passageway 136 generally at a right angle to and away from the outer surface of the main portion 134 of the front wall in a projecting position of the front wall to define an exit slot for the sheets 18 therebetween. The first end portion 20 of the uppermost sheet 18 in the stack then projects between the projecting end parts 139 and is supported in a position projecting above the outer surface of the main portion 134 of the front wall. The projecting end parts 139 will then normally support in that same position the end portions 20 of subsequent sheets 18 positioned to be withdrawn from the dispenser 130 as a result of sheets 18 being withdrawn from the dispenser 130. The projecting end parts 139, however, can be resiliently compressed to a retracted position lying along the outer surface of the main front wall portion 134 with the end portion 20 of the sheet 18 therebetween also along that surface to reduce the thickness of the dispenser 130 when, for example, the rear wall 133 of the housing 131 is attached along a page in a book and the book is closed. When the compressive force is relieved (e.g., when the book is opened) the projecting end parts 139 will return to their normal position to again cause the end portion 20 of the top sheet 18 to project above the outer surface of the main portion 134 of the front wall where it can be easily grasped by a person wishing to withdraw it from the dispenser 130. The dispenser 130 could also be modified to be of the type in which the bottom sheet on the stack 14 of sheets 18 is fixed in position along the rear wall and the sheets 18 are dispensed through a wider slot as is taught in U.S. Pat. No. 4,907,825 (Miles et al) by reducing the size of the chamber so that the stack can not reciprocate in it and moving the end parts 139 apart to make the slot through which the sheets are dispensed much wider.

The dispenser according to the present invention has now been described with reference to several embodiments and modifications thereof It will be apparent to those skilled in the art that many changes can be made in the embodiments described without departing from the scope of the present invention. Thus, the scope of the present invention should not be limited to the structures described in this application, but only by the structures described by the language of the claims and the equivalents thereof.

What is claimed is:

1. A sheet dispenser adapted to be positioned between pages of a book, magazine, personal organizer or the like, said sheet dispenser comprising:

a stack of dispensable sheets each having a first end portion, being disposed one on top of another, and including an uppermost sheet, an underlying sheet directly beneath the uppermost sheet, and a lowermost sheet;

a housing having walls defining a chamber in which said stack of dispensable sheets is positioned, said walls including a rear wall positioned adjacent the lowermost sheet in the stack and a front wall positioned adjacent said uppermost sheet, having an outer surface opposite said chamber, and having adjacent edges defining a through slot extending transversely across said stack with the first end portion of the uppermost dispensable sheet in the stack extending through said slot;

said dispensable sheets including means for releasably attaching the uppermost sheet to the first end portion of the underlying sheet in the stack sufficiently to carry the first end of the underlying sheet through the slot when the first sheet is removed from the dispenser by manually pulling the first end portion of the uppermost sheet through the slot and to position the first end portion of the underlying dispensable sheet in a position extending through the slot as a result of said dispensing;

said front wall being movable between a projecting position with at least parts of said front wall on opposite sides of said slot projecting above the stack and with one of said front wall parts disposed to support the first end portion of the uppermost sheet in a position projecting above the outer surface of the front wall, and a retracted position with said front wall disposed closely adjacent and generally parallel with the sheets on said stack to reduce the thickness of said dispenser.

2. A dispenser according to claim 1 wherein said front wall comprises front wall portions formed of resiliently flexible material and having opposite proximal and distal ends, said proximal ends being attached to said rear wall and each of said front wall portions providing one of said adjacent edges defining said slot and one of said parts for supporting the first end portion of the uppermost sheet in a position projecting above the outer surface of the front wall; said front wall portions being resiliently flexible and compressible to said retracted position.

3. A dispenser according to claim 2 wherein said distal ends of said front wall portions provide said adjacent edges defining said slot, and said front wall portions comprise generally planar sections defining said distal ends disposed with said distal ends projecting above said stack and providing said parts for supporting the first end portion of the uppermost sheet in a position projecting above the outer surface of said front wall.

4. A dispenser according to claim 2 wherein said distal ends provide said adjacent edges defining said slot and said parts on said wall portions for supporting the first end portion of the uppermost sheet in a position projecting above the outer surface of said front wall are positioned generally centrally between said distal and proximal ends of said wall portions.

5. A dispenser according to claim 4 wherein said parts on said wall portions for supporting the first end portion of the uppermost sheet in a position projecting above the outer surface of said front wall are formed by the intersection of two generally planar sections of each of said wall portion disposed at an angle with respect to each other.

6. A dispenser according to claim 4 wherein said wall portions are each arcuate and have convex surfaces opposite said rear wall to provide the parts on said wall portions for supporting the first end portion of the uppermost sheet in a position projecting above the outer surface of said front wall.

7. A dispenser according to claim 2 wherein said front wall portions each comprise first and second generally planar sections having opposite sides, said first and second sections being joined to each other at adjacent sides and being disposed at an acute angle with respect to each other with the sides of said second sections opposite said adjacent sides being said distal ends and being supported on said stack and said adjacent sides on said two front wall portions being spaced apart and having said edges defining said slot.

8. A dispenser according to claim 2 wherein each of said front wall portions has two sections that are generally planar and have opposite sides, are attached end to end to each other at adjacent sides, and are disposed at an included angle in the range of 60 to 140 degrees with respect to each other with the end of one of said sections opposite said adjacent sides having one of said adjacent edges defining said slot and projecting above said stack to provide said part supporting the first end portion of the uppermost sheet in a position projecting above the outer surface of said front wall.

9. A dispenser according to claim 1 wherein said front wall comprises an outer layer of flexible material defining said outer surface and a layer of resiliently compressible material between said outer layer and said stack of dispensable sheets to position said front wall with said edges defining said slot along said outer surface projecting above said stack to provide said parts for supporting the first end portion of the uppermost sheet in a position projecting above the outer surface of said front wall, said layer of resiliently compressible material being resiliently compressible to said retracted position with said outer surface of said front wall disposed closer to the sheets on said stack to reduce the thickness of said dispenser.

10. A dispenser according to claim 1 wherein said front wall comprises front wall portions formed of material with each of said front wall portions having two sections that are generally planar and have opposite sides, are attached end to end to each other at adjacent sides, and are disposed at an included angle in the range of 80 to 140 degrees with respect to each other with said first section being of stiff material and being disposed generally parallel with the sheets in said stack, and the second section being of resiliently flexible material with the sides of said second sections opposite said adjacent sides having said adjacent edges defining said slot and projecting above said stack to support the first end portion of the uppermost sheet in a position projecting above the outer surface of said front wall, said second sections being resiliently compressible to said retracted position with said second sections disposed generally parallel with the sheets on said stack to reduce the thickness of said dispenser.

11. A dispenser according to claim 1 wherein said front wall comprises a front wall portion formed of stiff material having a through passageway aligned with and generally corresponding in size and shape to said slot, and second and third front wall portions of resiliently flexible material having attached end parts attached along the inner surface of said front wall portion on opposite sides of said passageway and projecting end parts adapted to project across said passageway in overlapped relationship, said first end portion of said uppermost sheet projecting between said end parts and through said slot, withdrawing of said uppermost sheet from said stack arching and moving said projecting end parts to opposed relationship projecting generally at a right angle to and away from the outer surface of said front wall to define said slot with the first end portion of the second sheet in the stack projecting between the projecting end parts and being supported in a position projecting above the outer surface of the front wall, said projecting end parts being manually returnable to said overlapped relationship with said first end portion of the new uppermost sheet in the stack projecting between said end parts and laying along the outer surface of said front wall.

12. A dispenser according to claim 1 wherein said front wall has a periphery, is formed of stiff resiliently flexible material, and is attached to said rear wall along said periphery with said front wall arched away from said rear wall to said projecting position, and said dispenser includes means for retaining said stack along said rear wall so that said front wall arched above said stack supports the first end portion of the uppermost sheet in a position projecting above the outer surface of the front wall, said front wall being resiliently moveable to said retracted position with said front wall disposed more closely adjacent the sheets on said stack to reduce the thickness of said dispenser.

13. A dispenser according to claim 12 wherein said housing further includes spring portions on opposite sides of and integral with said front wall, said housing being bent between said front wall and said spring portions to position said spring portions between said rear wall and said front wall and the resilient flexibility of said material in the bend between said front wall and said spring portions providing means for biasing said front wall to said projecting position.

14. A dispenser according to claim 1 wherein said front wall comprises a main front wall portion formed of flexible material having a through passageway aligned with and generally corresponding in size and shape to said slot, and two front wall portions of resiliently flexible material having attached end parts attached along the inner surface of said main front wall portion on opposite sides of said passageway and projecting end parts in opposed relationship projecting generally at a right angle to and away from the outer surface of said main front wall portion to define said slot with the first end portion of the sheet in the stack projecting between the projecting end parts and being supported in a position projecting above the outer surface of the main portion of the front wall, said projecting end parts being manually compressible to a position laying along the outer surface of the main portion of the front wall along with said first end portion of the sheet.

15. A dispenser according to claim 14 wherein the opposed surfaces of said attached end parts have a coating of release material.

16. A dispenser according to claim 14 wherein the opposed surfaces of said attached end parts are embossed to restrict adhesion thereto.

17. A low profile sheet dispenser adapted for placement in a book, notebook, personal organizer, or the like, for individually dispensing sheets from a coherent stack of sheets, comprising:

(a) a housing including a front wall, a rear wall, and end walls arranged to define a chamber for receiving the stack of sheets therein, said front wall containing a slot through which an end portion of an upper-most sheet of the stack extends, said front wall including abutment means arranged adjacent said slot, said abutment means being movable between (1) a dispensing position wherein said abutment means extend above said slot to support the end portion of said upper-most sheet above said front wall, whereby the sheet end portion extending through said slot can be easily grasped by a user to withdraw said upper-most sheet from said housing, and (2) a compressed position wherein said abutment means are arranged generally adjacent the stack of sheets, thereby reducing the thickness of the sheet dispenser for compact storage between uses.

* * * * *